US011930937B2

(12) United States Patent
Mackert

(10) Patent No.: US 11,930,937 B2
(45) Date of Patent: Mar. 19, 2024

(54) SEATING FURNITURE CHASSIS

(71) Applicant: Innotec Motion GmbH, Lippstadt (DE)

(72) Inventor: Michael Mackert, Rüthen (DE)

(73) Assignee: Innotec Motion GmbH, Lippstadt (DE)

( * ) Notice: Subject to any disclaimer, the term of this patent is extended or adjusted under 35 U.S.C. 154(b) by 329 days.

(21) Appl. No.: 17/524,246

(22) Filed: Nov. 11, 2021

(65) Prior Publication Data

US 2022/0061533 A1 Mar. 3, 2022

Related U.S. Application Data

(63) Continuation of application No. PCT/EP2020/070702, filed on Jul. 22, 2020.

(30) Foreign Application Priority Data

Jul. 23, 2019 (DE) ..... 202019104069.6

(51) Int. Cl.
*A47C 7/50* (2006.01)
*A47C 1/034* (2006.01)

(52) U.S. Cl.
CPC ..... *A47C 7/5068* (2018.08); *A47C 1/034* (2013.01); *A47C 1/0345* (2013.01); *A47C 7/5062* (2018.08)

(58) Field of Classification Search
CPC ..... A47C 7/5068; A47C 1/034; A47C 1/0345; A47C 7/5062; A47C 1/0347; A47C 7/00; A47C 7/506
USPC ..... 297/68, 75, 423.19, 423.2, 423.28, 297/423.29, 423.3
See application file for complete search history.

(56) References Cited

U.S. PATENT DOCUMENTS 3,054,640 A * 9/1962 Lorenz ..... A47C 1/0347 297/89
5,857,739 A * 1/1999 Smith ..... A47C 1/03255 297/68
2011/0248544 A1* 10/2011 Adams ..... A47C 1/0355 297/423.19

(Continued)

FOREIGN PATENT DOCUMENTS

DE 202006014927 U1 1/2007

OTHER PUBLICATIONS 5 page PDF of English translation of the written opinion dated Oct. 15, 2020 in parent application PCT/EP2020/070702. (Year: 2020).*

(Continued)

*Primary Examiner* — Robert Canfield
(74) *Attorney, Agent, or Firm* — Edell, Shapiro & Finnan, LLC

(57) ABSTRACT

A seating furniture chassis comprises a seat surface frame, a leg rest chassis, first and second struts, and a retractable and extendable leg rest extension. The leg rest chassis is pivotably arranged on the seat surface frame and pivotable from a folded-out position into a folded-in position. The first strut includes a first elongated hole and a first guide element. The second strut includes a second elongated hole and a second guide element, wherein the second guide element is arranged displaceably in the first elongated hole, and the first guide element is arranged displaceably in the second elongated hole. The leg rest extension is arranged on the leg rest chassis and connected thereto by the first and second struts.

17 Claims, 4 Drawing Sheets

(56) References Cited

U.S. PATENT DOCUMENTS

| | | | | |
|---|---|---|---|---|
| 2019/0241108 | A1* | 8/2019 | Kim | B60N 3/063 |
| 2020/0146456 | A1* | 5/2020 | Pritchard | A47C 7/5066 |
| 2022/0087422 | A1* | 3/2022 | Mackert | A47C 1/0355 |
| 2023/0200534 | A1* | 6/2023 | Lu | A47C 1/0347<br>297/362.11 |

OTHER PUBLICATIONS

Search Report in corresponding International Patent Application No. PCT/EP2020/070702, dated Oct. 15, 2020, with English translation.

* cited by examiner

SEATING FURNITURE CHASSIS

CROSS REFERENCE TO RELATED APPLICATIONS

This application is a continuation of International Application No. PCT/EP2020/070702, filed on Jul. 22, 2020, which claims priority under 35 U.S.C. § 119 to Application No. DE 202019104069.6 filed on Jul. 23, 20219, the entire contents of which are hereby incorporated by reference.

TECHNICAL FIELD

The present disclosure relates to a seating furniture chassis.

BACKGROUND

Seating furniture chassis with a pivotable leg rest chassis are known from the prior art. The leg rest chassis can be folded in and out in order to be used either by the user as a leg rest or else to be stored underneath the seat surface without taking up much space when the leg rest chassis is not needed. In addition, leg rest extensions are known from the prior art. Such leg rest extensions lengthen the leg rest in the folded-out state of the leg rest chassis and are retracted in the folded-in state of the leg rest chassis.

SUMMARY

In contrast, the present disclosure describes a seating furniture chassis with an improved extending mechanism for the leg rest extension.

The seating furniture chassis comprises a seat surface frame, a leg rest chassis that is pivotably arranged on the seat surface frame, and a retractable and extendable leg rest extension that is arranged on the leg rest chassis. In this case the term "seat surface frame" is understood in the context of this description to mean a frame on which a cushion can be arranged that can be used then as a seat surface for a user.

The leg rest chassis can be pivoted from a folded-out position into a folded-in position and vice versa. The leg rest extension is connected to the leg rest chassis by first and second struts. The first strut has an elongated hole and a first guide element. The second strut has a second elongated hole and a second guide element. The second guide element is arranged displaceably in the first elongated hole. The first guide element is arranged displaceably in the second elongated hole.

A particularly smooth extension and retraction movement of the leg rest extension is achieved by guiding the guide elements in the elongated holes. Due to the possibility of moving the guide elements in the elongated holes, the leg rest extension can be extended and retracted a relatively long distance in a relatively small amount of space.

According to one disclosed embodiment, the first guide element and the second guide element each comprise a ball bearing. This arrangement ensures a relatively low degree of friction, so that relatively little force is required for the retracting and extending movement of the leg rest extension.

According to one disclosed embodiment, the first elongated hole may have a curved shape. The term "curved shape" is understood in the context of this description to mean, in particular, a shape that has round directional changes in the boundaries of the elongated hole. Owing to the curved shape the guide element is guided advantageously on an arched shape.

According to one disclosed embodiment, the first strut may have a base body. The first elongated hole can extend at an angle of greater than 45° away from the base body. In this case the base body defines in essence the shape of the strut as such. Since the first elongated hole protrudes away from the base body, the leg rest extension can be extended particularly far.

According to one disclosed embodiment, the second elongated hole can have an open end. This arrangement is particularly advantageous for assembling the seating furniture chassis. The first guide element can be inserted into the open end of the second elongated hole without much effort.

According to one disclosed embodiment, the first strut can be pivotable relative to the leg rest chassis and to the second strut.

According to one disclosed embodiment, the second strut can be pivotable relative to the first strut and to the leg rest extension.

According to one disclosed embodiment, the first strut can be pivotable about a first point of rotation. The first strut can be attached to the first point of rotation on the leg rest chassis.

According to one disclosed embodiment, the first point of rotation can be arranged in a fixed position relative to the leg rest chassis. In this case the term "in a fixed position" is understood in the context of this description to mean that the first point of rotation does not move relative to the leg rest chassis.

According to one disclosed embodiment, the second strut can be pivotable about a second point of rotation. The second strut can be attached to the second point of rotation on the leg rest extension.

According to one disclosed embodiment, the second point of rotation can be in a fixed position relative to the leg rest extension.

According to one disclosed embodiment, when the first strut is pivoted about the first point of rotation, the first guide element and the second guide element are moved in the first or second elongated hole, respectively.

According to one disclosed embodiment, the second guide element can be arranged between the second elongated hole and the second point of rotation.

According to one disclosed embodiment, the seating furniture chassis may comprise a third strut that is arranged at a first end pivotably on the seat surface chassis. At a second end the third strut is connected to an arm arranged on the first strut. The third strut can deflect the first strut during the fold in movement of the leg rest chassis. This action can occur, in particular, when the third strut exerts a force on the arm.

According to one disclosed embodiment, the arm can be spaced apart from the first strut by more than 90° on a geometric circle about the first point of rotation. In this case, the center point of the geometric circle may be defined by the first point of rotation. In this case, the term "geometric circle" is understood to mean, in particular, a circle that is not present as a component. The geometric circle may be virtual and may serve merely to define the position of the arm.

According to one disclosed embodiment, the leg rest chassis can be pivotable about a geometric axis of rotation. During the fold in process of the leg rest chassis, the first end of the third strut can be moved in a horizontal direction via the geometric axis of rotation. In this case, the term "horizontal direction" is understood to mean in the context of this description a direction that is horizontal when the seating furniture chassis is used as intended. In addition, in order to move in the horizontal direction, a movement component in a vertical direction may also be present.

According to one disclosed embodiment, the leg rest extension can be retracted farther than in the folded-in state of the leg rest chassis at a time instant during the fold in process of the leg rest chassis. This aspect is particularly advantageous, since the leg rest extension should be retracted as far as possible, when the leg rest chassis is folded in so far that it lies on the shortest path between the front end of the seat surface frame and the floor surface, on which the seating furniture chassis is standing. At this point it should be prevented that the leg rest chassis or the leg rest extension touches the floor surface. During the fold in process it is advantageous thereafter to extend then once again the leg rest extension just a little, because then the fabric, with which the leg rest chassis and ultimately also the leg rest extension are covered, is stretched, so that the risk of undesired folds in the fabric is reduced.

BRIEF DESCRIPTION OF THE DRAWINGS

Other features and advantages of the disclosed seating furniture chassis will become apparent from the following description of example embodiments with reference to the accompanying drawings. In this case the same reference numerals are used for the same or similar components and for components with the same or similar functions. In the drawings.

DETAILED DESCRIPTION

Figure 1:
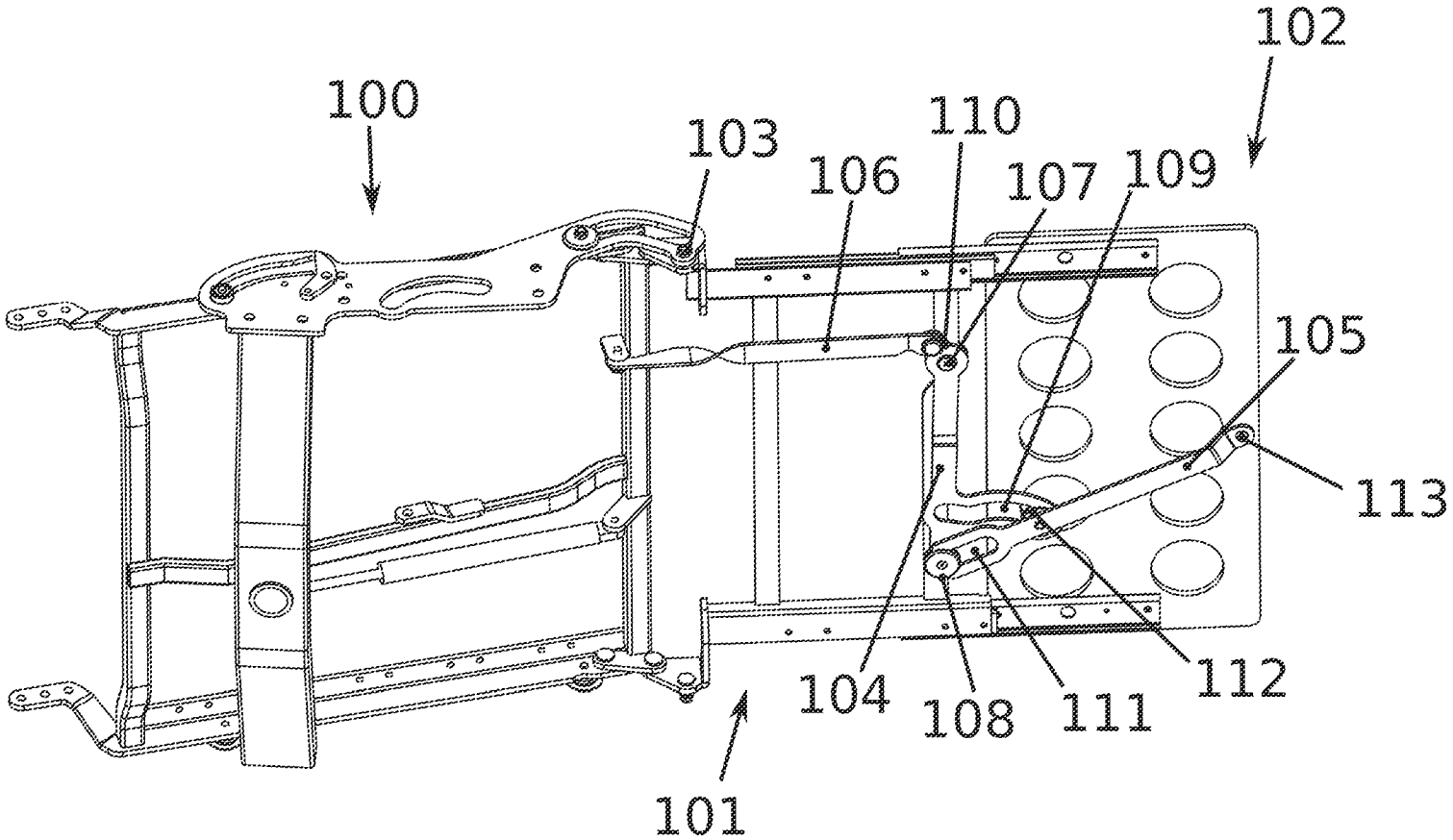
FIG. 1 shows in schematic form a perspective view of a seating furniture chassis according to one disclosed embodiment, with a folded-out leg rest chassis and an extended leg rest extension.

The seating furniture chassis comprises a seat surface frame 100, a leg rest chassis 101 and a leg rest extension 102. FIGS. 1 to 4 show a fold in movement of the leg rest chassis. When the figures are viewed in the reverse order of sequence, the result is a fold out movement of the leg rest chassis.

The leg rest chassis 101 is pivotable about a geometric pivot axis. In this case the pivot axis is defined by the pivot element 103. The pivoting movement of the leg rest chassis 101 is triggered when the seat surface frame 100 is moved forward, i.e., in the direction of the leg rest chassis 101, or is moved rearward, i.e., away from the leg rest chassis 101. When the seat surface frame 100 is moved forward, the leg rest chassis 101 is folded in. When the seat surface frame 100 is moved rearward, the leg rest chassis 101 is folded out.

The seating furniture chassis comprises a first strut 104, a second strut 105, and a third strut 106. The leg rest extension 102 is connected to the leg rest chassis 101 by the first strut 104 and the second strut 105. The second strut 105 is connected to the seat surface frame 100 by the third strut 106. The first strut 104 can be rotated about a first point of rotation 107 and comprises, in addition, a first elongated hole 109, a first guide element 108, and an arm 110. The third strut 106 is connected to the arm 110. The second strut 105 can be rotated about a second point of rotation 113 and comprises a second elongated hole 111 and a second guide element 112.

The second elongated hole 111 is open on one side. This arrangement has the advantage that during the assembly of the seating furniture chassis the first guide element 108 can be inserted into the elongated hole without any further effort.

Figure 2:
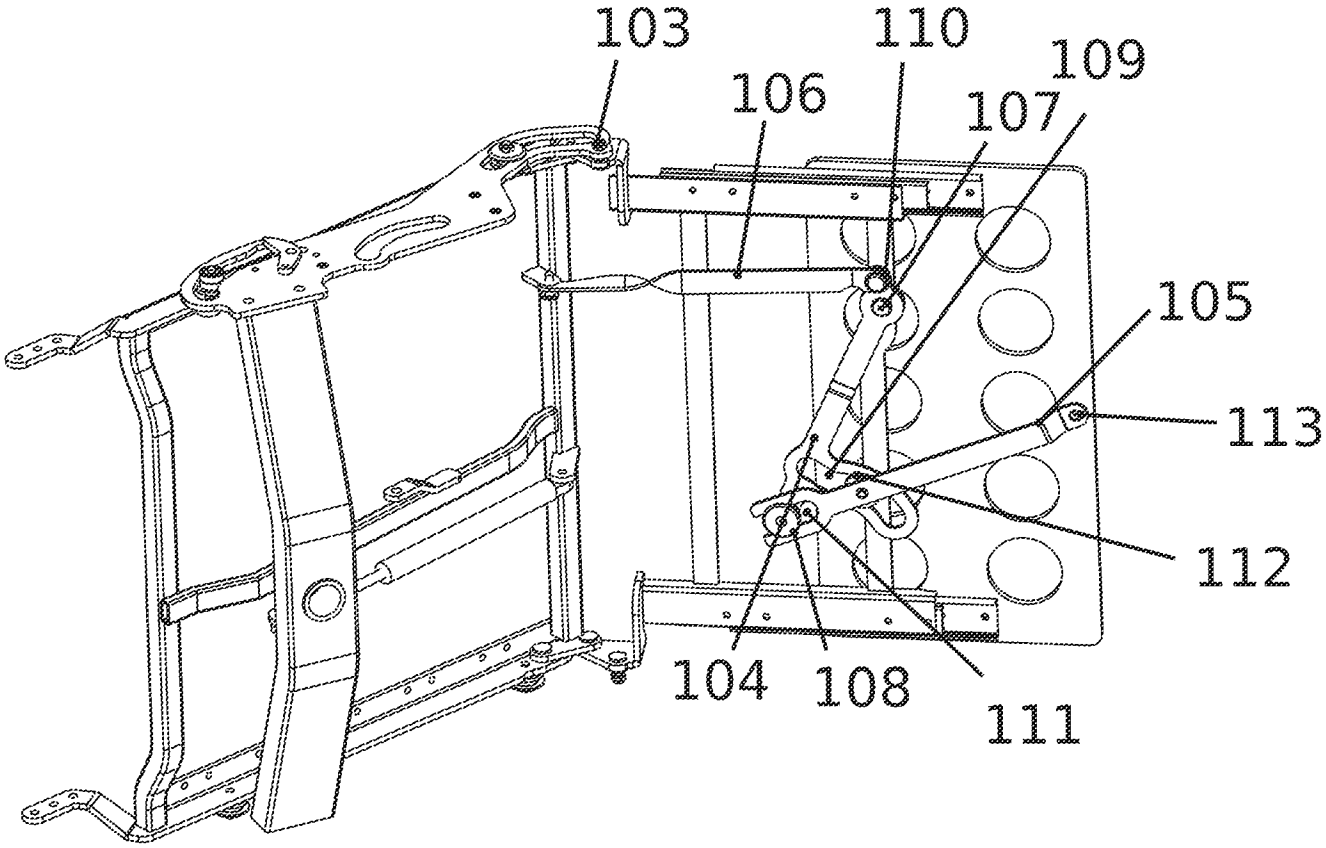
FIG. 2 shows in schematic form a perspective view of the seating furniture chassis from FIG. 1 with a partially folded-in leg rest chassis and a partially retracted leg rest extension.
Figure 3:
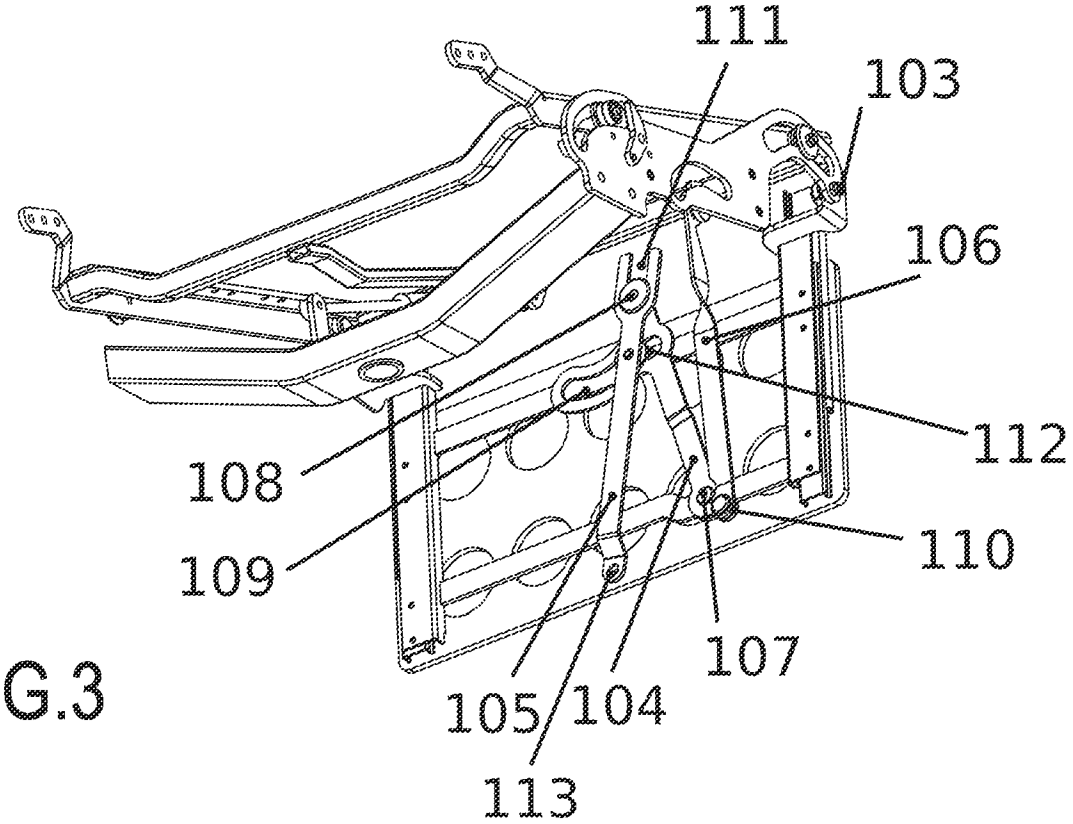
FIG. 3 shows in schematic form a perspective view of the seating furniture chassis from FIG. 1 with a leg rest chassis that is folded in farther as compared to FIG. 2, and a totally retracted leg rest extension.
Figure 4:
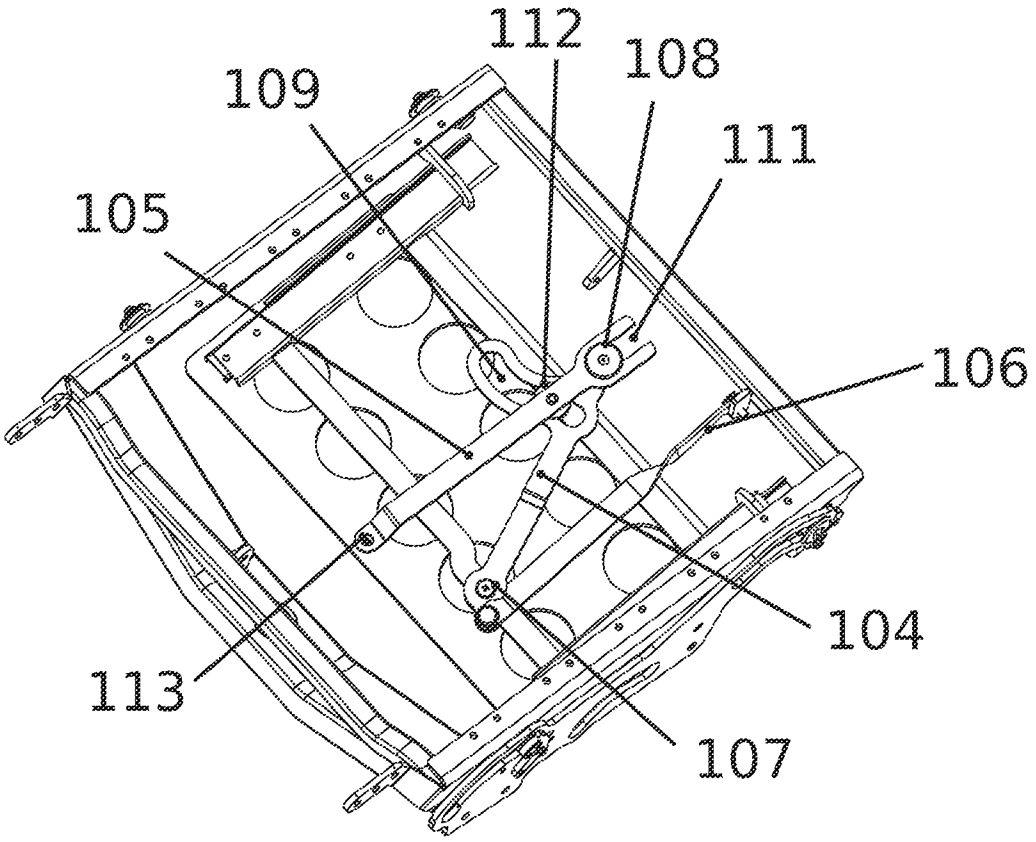
FIG. 4 shows in schematic form a perspective view of the seating furniture chassis from FIG. 1 with a completely folded-in leg rest chassis and a leg rest extension that is partially extended again just a little as compared to FIG. 3.

During the fold in movement of the leg rest chassis 101 shown in FIGS. 1 to 3, the third strut 106 is pushed forward due to it being attached to the seat surface frame 100, so that the third strut exerts a force on the arm 110 to which the third strut is connected. This force triggers a pivoting of the first strut 104 about the first point of rotation 107. Owing to the arrangement of the second guide element 112 in the first elongated hole 109, the curved shape of the elongated hole 109 and the arrangement of the first guide element 108 in the second elongated hole 111, the second strut 105 is pivoted about the second point of rotation 113 and is pulled in the direction of the leg rest chassis 101.

In FIG. 3, the leg rest extension 102 is completed retracted. This is particularly advantageous in this position, because the leg rest chassis 101 is located in the position with the shortest distance between the seat surface frame 100 and the floor surface on which the seating furniture chassis is standing. In order to provide a comparatively long support surface for the legs of a user in a comparatively small amount of space, it is advantageous for the leg rest extension 102 to be completely retracted in this position.

When the leg rest chassis 101 is folded in farther, the leg rest extension 102 is extended again just a little, in order to be able to stretch a fabric, with which the leg rest extension 102 and the leg rest chassis 101 can be covered. In this way, the risk of undesired folds in the fabric is reduced when the leg rest chassis 101 is folded in. This state is achieved by moving the end of the third strut 106, which is connected to the seat surface frame 100, in the horizontal direction via the pivot axis of the leg rest chassis. After this movement, the third strut 106 pulls on the arm 110 during the continued fold in movement of the leg rest chassis 101 so that the leg rest extension 102 is extended.

What is claimed is:

1. A seating furniture chassis, comprising:

a seat surface frame;

a leg rest chassis pivotably arranged on the seat surface frame and pivotable from a folded-out position into a folded-in position;

a first strut including a first elongated hole and a first guide element;

a second strut including a second elongated hole and a second guide element, wherein the second guide element is arranged displaceably in the first elongated hole, and the first guide element is arranged displaceably in the second elongated hole; and a retractable and extendable leg rest extension arranged on the leg rest chassis and connected to the leg rest chassis by the first and second struts.

2. The seating furniture chassis of claim 1, wherein the first guide element and the second guide element each comprise a ball bearing.

3. The seating furniture chassis of claim 1, wherein the first elongated hole has a curved shape.

4. The seating furniture chassis of claim 1, wherein the first strut has a base body, and the first elongated hole extends at an angle of greater than 45° away from the base body.

5. The seating furniture chassis of claim 1, wherein the second elongated hole has an open end.

6. The seating furniture chassis of claim 1, wherein the first strut is pivotable relative to the leg rest chassis and to the second strut.

7. The seating furniture chassis of claim 1, wherein the second strut is pivotable relative to the first strut and to the leg rest extension.

8. The seating furniture chassis of claim 1, wherein the first strut is pivotable about a first point of rotation, wherein the first strut is attached to the first point of rotation on the leg rest chassis.

9. The seating furniture chassis of claim 8, wherein the first point of rotation is arranged in a fixed position relative to the leg rest chassis.

10. The seating furniture chassis of claim 8, wherein the second strut is pivotable about a second point of rotation, wherein the second strut is attached to the second point of rotation on the leg rest extension.

11. The seating furniture chassis of claim 10, wherein the second point of rotation is arranged in a fixed position relative to the leg rest extension.

12. The seating furniture chassis of claim 10, wherein the second guide element is arranged between the second elongated hole and the second point of rotation.

13. The seating furniture chassis of claim 8, wherein when the first strut is pivoted about the first point of rotation, the first guide element and the second guide element are moved in the first elongated hole or the second elongated hole, respectively.

14. The seating furniture chassis of claim 1, further comprising:

a third strut arranged at a first end pivotably on the seat surface frame, and wherein at a second end the third strut is connected to an arm arranged on the first strut, and wherein the third strut deflects the first strut during a fold in movement of the leg rest chassis.

15. The seating furniture chassis of claim 14, wherein the arm is spaced apart from the first strut by more than 90° on a geometric circle about the first point of rotation.

16. The seating furniture chassis of claim 15, wherein the leg rest chassis is pivotable about a geometric axis of rotation, wherein during the fold in movement of the leg rest chassis, the first end of the third strut is moved in a horizontal direction by the geometric axis of rotation.

17. The seating furniture chassis of claim 1, wherein at a time instant during a fold in movement of the leg rest chassis, the leg rest extension is retracted farther than in the folded-in position of the leg rest chassis.

* * * * *